United States Patent [19]

Ejen

[11] Patent Number: 4,993,300

[45] Date of Patent: Feb. 19, 1991

[54] METHOD OF PLAYING A FRETTED STRING INSTRUMENT

[76] Inventor: Gary Ejen, 120-3J DeKruif Pl., Bronx, N.Y. 10475

[21] Appl. No.: 100,792

[22] Filed: Sep. 24, 1987

Related U.S. Application Data

[60] Division of Ser. No. 731,817, May 8, 1985, abandoned, which is a continuation-in-part of Ser. No. 579,244, Feb. 13, 1984, abandoned.

[51] Int. Cl.[5] ..... G10D 3/06

[52] U.S. Cl. ..... 84/314 R; 84/DIG. 30

[58] Field of Search ..... 84/1.14–1.16, 84/173, 267–269, 284, 285, 312 R, 314 R, DIG. 30

[56] References Cited

U.S. PATENT DOCUMENTS 2,989,884 6/1961 Bunker ..... 84/1.16
4,142,436 3/1979 Chapman ..... 84/1.16

OTHER PUBLICATIONS

Jimmie Webster, *Illustrated "Touch System", for Electric and Amplified Spanish Guitar,* Published by Wm. J. Smith Music Co., New York, NY, copyright 1952.

*Primary Examiner*—Stanley J. Witkowski
*Attorney, Agent, or Firm*—Nolte, Nolte and Hunter

[57] ABSTRACT

A method of playing a fretted string instrument having a body, a neck, a single elongated fingerboard on the neck and conventional strings in tension over the body between a head and bridge thereof; the fingerboard extending rearwardly of the neck over the body and including at least about twenty-five frets, a substantial number of which frets overlie the body, means for retaining the instrument against the body of the instrumentalist and angularly disposed relative to the vertical, the fingerboard being outwardly convexed, the forward edges of the body adjacent the fingerboard diverging rearwardly, the fingerboard thereby being accessible to the fingers of both hands approaching the fingerboard from opposite sides throughout the length of the fingerboard, neck and body, the method comprising the instrumentalist retaining the instrument against the instrumentalist's body and angularly disposed relative to the vertical with the single fingerboard facing outwardly, approaching the strings with the fingers of one hand from one side of the fingerboard and with the fingers of the other hand from the other side of the fingerboard, and tapping, bending and pulling at least one of the strings along the length of the fingerboard with the fingers of both hands by applying the fingers of the other hand in advance of the position of the one hand and then applying the fingers of the other hand again in a position in advance of the position of the other hand in either direction.

1 Claim, 6 Drawing Sheets

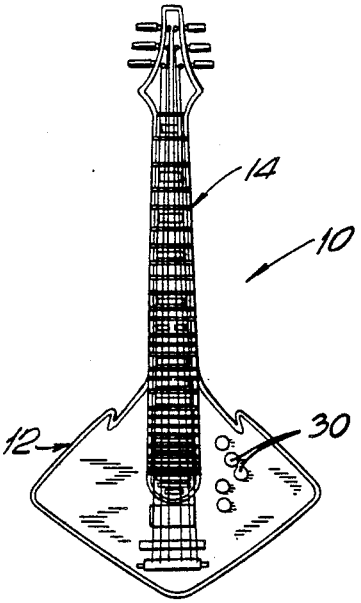
FIG. 3
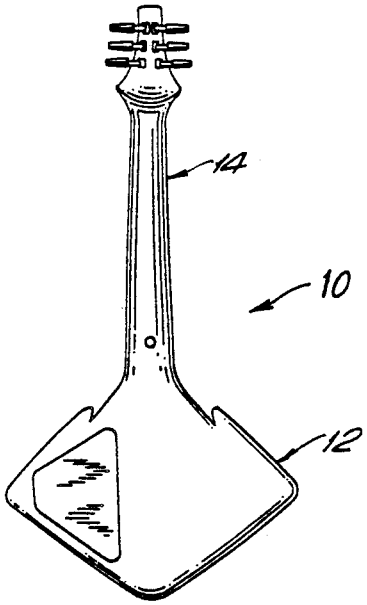
FIG. 4
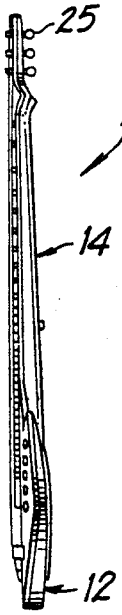
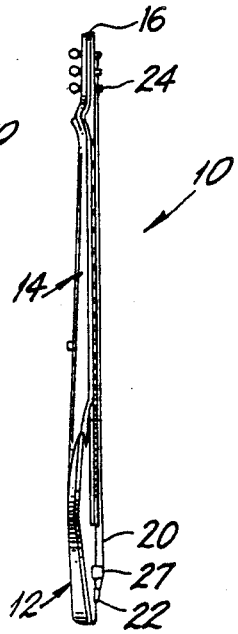
FIG. 5 FIG. 6
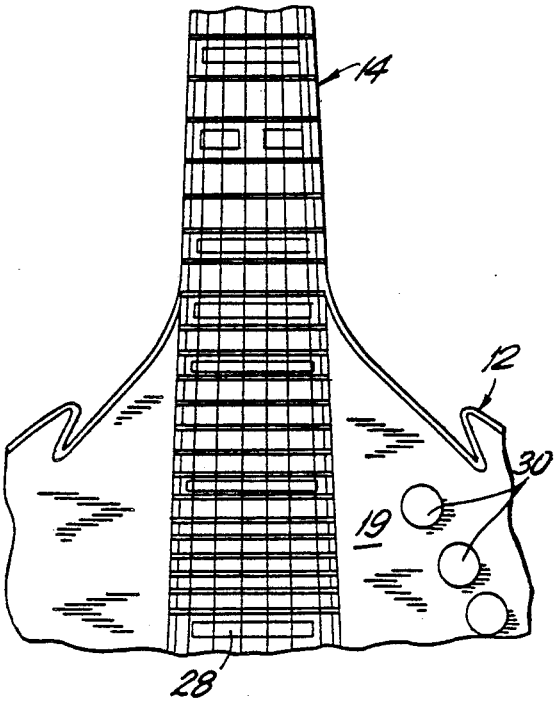
FIG. 7

METHOD OF PLAYING A FRETTED STRING INSTRUMENT

CROSS-REFERENCE TO RELATED APPLICATION

This application is a division of application Ser. No. 731,817, filed May 8, 1985, now abandoned, which was a continuation-in-part of Ser. No. 579,244, filed Feb. 13, 1984, now abandoned.

BACKGROUND OF THE INVENTION

This invention relates to a novel electric guitar and to a novel method of playing the guitar.

As guitar playing has become popular, guitarists have sought new techniques to vary and expand the sound that is produced. With advances in the technology used in making electric guitars and with advances in making strings that can be bent, guitars have become vastly different sounding instruments. For example, sounds can be made on the electric guitar simply by touching its strings, and it is no longer necessary to pluck or pick the strings to produce sounds as required on acoustic guitars.

As guitarists have sought ways of expanding the use of electric guitars, they have found that they do not need to pick the guitars on high volumes or low volumes as much as was previously thought. Electric guitars allow for new ways of playing. As a result, guitar players can now use touching techniques; i.e., touching the strings with the fingers of either hand to produce interoctave sounds without picking. In this regard, electric guitars have been developed which are especially adapted to be played with both hands. For example, Chapman U.S. Pat. No. 3,833,751 discloses an electric stringed instrument of the guitar family with an extended fingerboard wide enough for nine strings to allow a performer to tap or touch bass chords with the fingers of one hand and melody with the fingers of the other hand and which is difficult to balance against the body of the instrumentalist so that it is played in a substantially vertical position. Also, the two-handed touching techniques which can be used on such guitars have generally been rather limited. Firstly, the circuitry for such guitars has to be changed to increase sensitivity so that notes will not meld into one another; as both bass and melody notes are played simultaneously. Also, such guitars have not been adapted to be played with a wide variety of the conventional finger movements upon the strings, such as pulling and bending the strings. This is because the fingerboards of such guitars have been flat so that the guitars can be played by simply depressing the strings or by tapping the strings and holding them against frets. Such guitars relegate the fingers of one hand to the bass and one hand to the melody and are thus not adapted to the played with the fingers of both hands playing chords and melodies at the same time over extended ranges of notes and by the use of intertwining hand-over-hand techniques for linking melody and chord patterns together on single and/or plural string.

Further, playing a two handed technique requires that the two hands play independently of one another. All stringed instruments have one thing in common; that is, the fretboard musically measures the key signatures with a dot. However, the keys of the piano, for examples, are identified as markers for sharps and flats, so that both hands share a relationship in coordination, linking one to the other. In the two handed techniques of the prior art, the two hands do not move in the relationships of the pianist's hands. Thus, no stringed instrument has been designed to provide a relationship where the two hands become one appendage both moving fluidly together as one scale and one chord, in that no stringed instrument has provided a visual means to locate the placement of the fingers of the hands in a two-hand playing technique.

SUMMARY OF THE INVENTION

In accordance with this invention, a fretted string instrument is provided comprising a body, a neck, an elongated fingerboard on said neck and a plurality of strings in tension over said fingerboard; said fingerboard extending rearwardly of said neck over said body and including at least about twenty-five frets, a substantial number of which frets overlie said body. In one preferred embodiment, said fingerboard has about twenty-five to thirty-five frets thereon, with at least about ten frets overlying said body and said fingerboard extends to about the middle of said body. Thus, an extended fretboard is provided for playing with two handed techniques without, however, extending the length of the guitar so that balance and reach in a stand up performance are not adversely affected.

In another preferred embodiment, said fingerboard has a convex upward curvature in cross-section. In still another preferred embodiment, said fingerboard, said neck and said body are formed as one piece and said fingerboard is located in a space formed in the face of said body. In yet another preferred embodiment, said body is generally diamond-shaped and is adapted to counterbalance the weight of the rest of said guitar and said neck and said fingerboard form an acute angle with said body.

The invention also contemplates the provision of tremelo levers positioned at the head piece and at the face of the body, and which vary pitch electronically rather than by string tension to enhance the instrumentalists ability to perform the two handed playing technique.

Also in accordance with this invention, a method of playing said guitar is provided which comprises tapping, bending or pulling said strings with both hands.

In the two handed playing techniques of the invention, plucking with eight fingers and bending strings in a guitar fashion, both hands become a single moving scale or chord pattern. To assist the instrumentalist, the fret board of the instrument of the present invention provides markings showing the sharps and flats for each string.

BRIEF DESCRIPTION OF THE DRAWINGS

FIG. 3 is a top plan view, similar to FIG. 2, of the guitar of FIG. 1.

FIG. 4 is a bottom plan view of the guitar of FIGS. 1–3.

FIG. 5 is a side elevation view of the guitar of FIGS. 1–4 as viewed from the right side of FIG. 3.

FIG. 6 is a side elevation view of the guitar of FIGS. 1-4 as viewed from the left side of FIG. 3.

FIG. 7 is a fragmentary top plan view of the guitar of FIGS. 1-3.

DETAILED DESCRIPTION OF THE PREFERRED EMBODIMENTS

Figure 1:
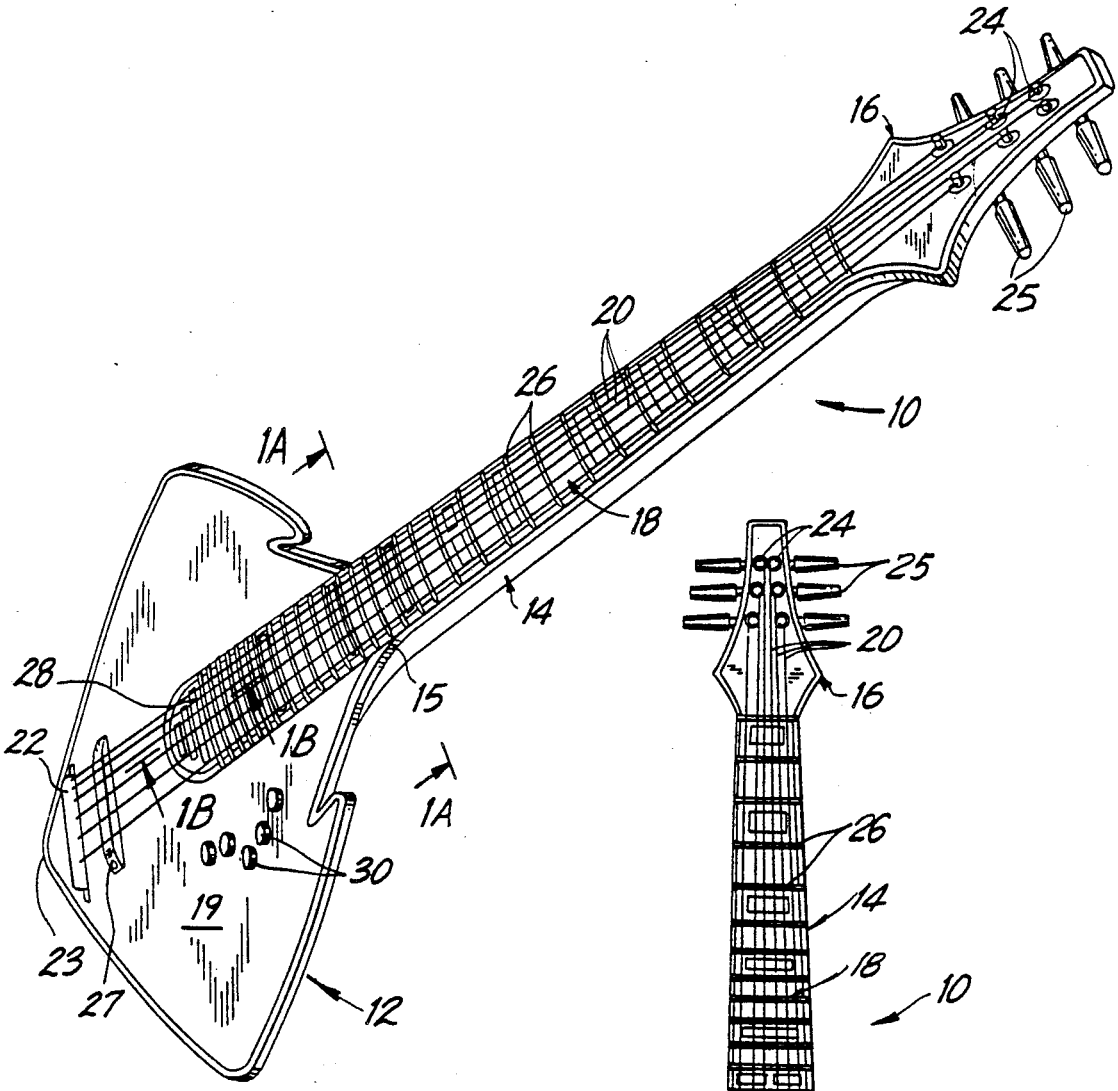
FIG. 1 is a schematic perspective view of one embodiment of a guitar of this invention.

Shown in FIGS. 1-7 is an electric guitar, generally 10, in accordance with one embodiment of this invention. The guitar includes a generally diamond-shaped body 12, an elongated neck 14 connected to the front corner 15 of the body 12, and a headpiece 16 on the front end of the neck remote from the body. A fingerboard 18 is mounted on the neck 14 and extends from the headpiece 16 along the length of the neck 14 and diagonally across a portion of the face 19 of the body 12. Preferably, the body 12, neck 14 and headpiece 16 are formed as one piece and the fingerboard 18 is located in a space formed in the face 19 of the guitar body 12 as shown in FIG. 1B. The fingerboard 18 preferably extends to about the middle of the face 19 of the body 12, where the sound hole is conventionally placed in an acoustic guitar. The body 12 is adapted to counterbalance the weight of the rest of the guitar 10, including the neck 14, headpiece 16 and the portions of the fingerboard 18 on the neck 14, so that the center of gravity of the guitar 12 is located where the neck 14 is formed to the body 12.

A plurality of strings 20 extend between a tail piece 22 on the face 19 of the body 12, near its rear corner 23, and pegs 24 in the headpiece 16. At least about twenty-five parallel upstanding frets 26 are provided on top of the fingerboard 18. On the face 19 of the body 12, between the tail piece 22 and the fingerboard 18, is a bridge 28 for providing fixed tuning for the strings 20 as they are brought into tension by the pegs 24. Also on the face 19 of the body 12, between the bridge 28 and the fingerboard 18, is a conventional sound pick-up unit 28. The sound pick-up unit 28 is electrically connected, along with a plurality of volume and tone control knobs 30 on the face 19 of the body 12, to conventional electric circuitry (not shown) within the body 12 that can be electrically connected to an external sound amplification system (not shown).

Figure 1A:
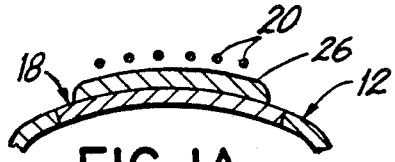
FIG. 1A is a section view, taken along line 1A—1A in FIG. 1.
Figure 1B:
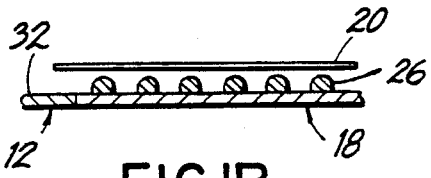
FIG. 1B is a section view, taken along line 1B—1B in FIG. 1.
Figure 2:
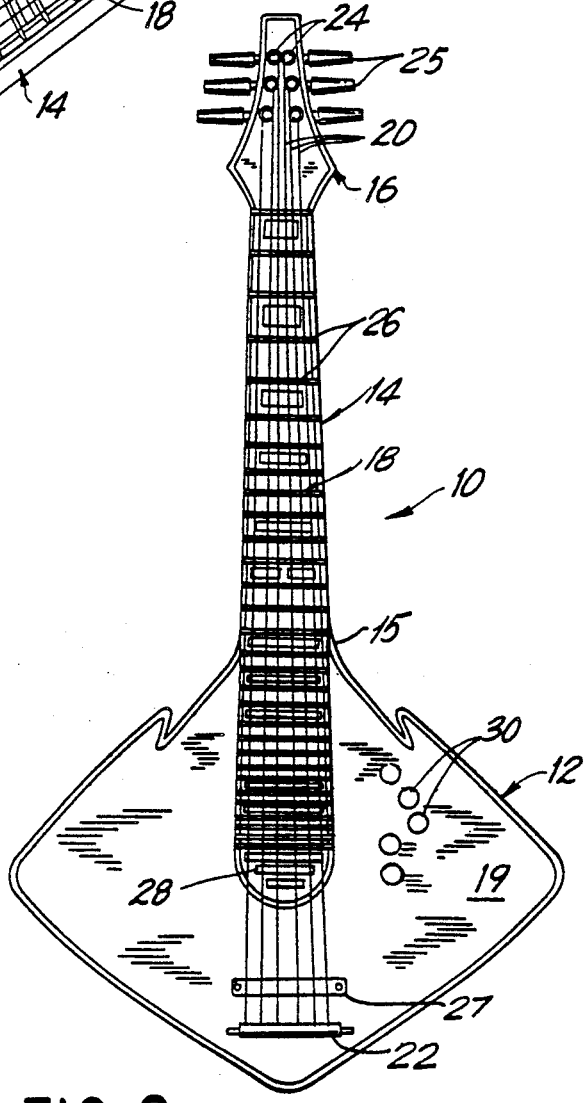
FIG. 2 is a top plan view of the guitar of FIG. 1.

As shown in FIG. 1A, the fingerboard 18 of guitar 10 of this invention has a convex upward curvature in cross-section. The convex cross-section of the fingerboard 18 provides more room for string bending and string pulling. This permits the guitar to be played by either tapping the strings in a conventional manner or by bending or pulling the strings with one or both hands (i.e., with eight fingers). The fingerboard 18 also has up to about thirty-five frets 26, preferably at least about thirty frets 26, at least about ten of which are located over the face 19 of the body 12. This large number of frets 26 extends the range of notes which can be played with either hand, using only six conventional strings 20. In this regard, the strings 20 of the guitar 10 can be tuned in a conventional manner, for example, to have the mid-ranges of the strings tuned primarily to allow the guitarist to play melodies and leads. However, tuning of the strings 20 can be varied to provide different scale patterns on different strings. The length of the fingerboard 18 also extends the range of leads and melodies which can be played by the guitarist with either hand and allows the most rapid and diverse use of the fingers of either hand playing along the fingerboard, including intertwining hand-over-hand methods of playing leads and melodies on the guitar 10. In this regard, the guitar 10 can be played with two hands by interconnecting the scales played by each hand to form a larger scale created by the two hands, descending and ascending the fingerboard, e.g., by intertwining the hands one over the other. In addition, the extended length of the fingerboard 18 produces less tension on the strings 20 for ease of fretting and obtaining feedback and for providing a greater range of feedback. Connected to each peg 24 is a conical knob 25. The conical knob 25 make it easier to tighten the strings 20 and thereby tune the guitar 10 more precisely, by making it possible to turn the gears (not shown) connecting the pegs 24 more precisely. Inasmuch as the fret board is extended, the distance between the frets 26 is greater than in a conventional guitar, thereby making it easier to accommodate playing chords with the fingers of both hands and to increase the ability to use the hand-over-hand technique.

Shown in FIGS. 8-12 is another embodiment of the guitar of this invention, generally 110. Elements of guitar 110, corresponding to elements of the guitar 10 of FIGS. 1-7, have reference numerals which differ by 100 from the reference numerals of the elements of the guitar 10. In this regard, the guitar 110 of FIGS. 8-12 has a generally diamond-shaped body 112, a neck 114, a headpiece 116, a fingerboard 118 and six strings 120 referring to headpiece 116 as the forward end, and referring to body 112 as the rearward end, the forward edges 115 of body 112 adjacent the fingerboard 118 diverge rearwardly. The fingerboard 118 extends diagonally across the body 112 between a sound pick-up unit 127 and the headpiece 116. The strings 120 extend between pegs 124 in the headpiece 116 over a novel bridge, generally 128, that also acts as the tail piece of the guitar and includes the sound pick-up unit 127 for the guitar as described below with reference to FIG. 10. On top of the fingerboard 118 are about twenty-five to thirty-five, preferably at least about thirty, frets 136.

Figure 8:
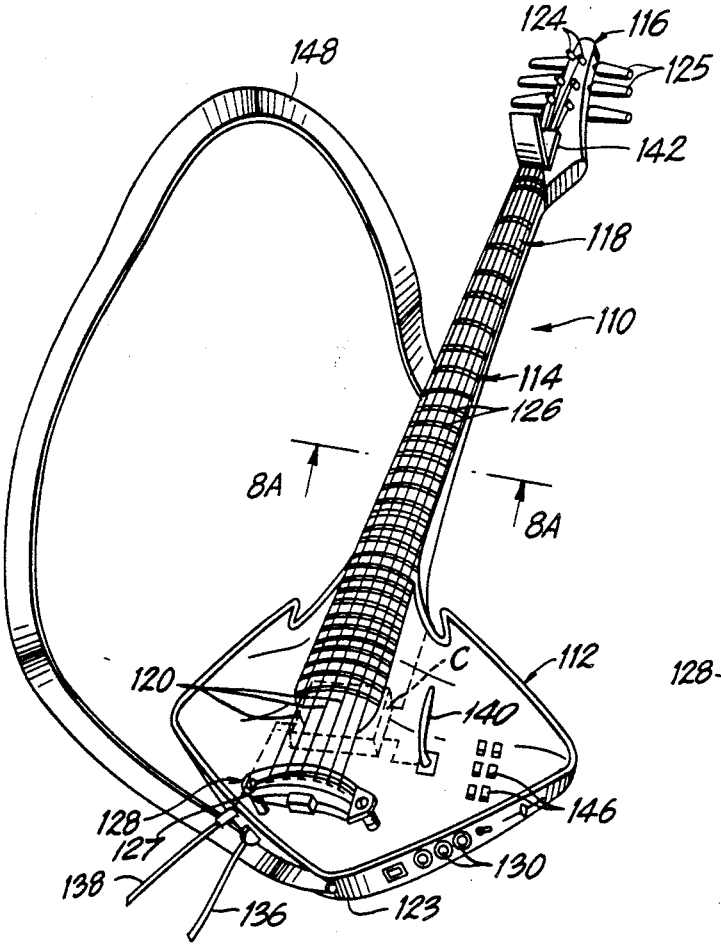
FIG. 8 is a schematic perspective view of another embodiment of the guitar of this invention.
Figure 8A:
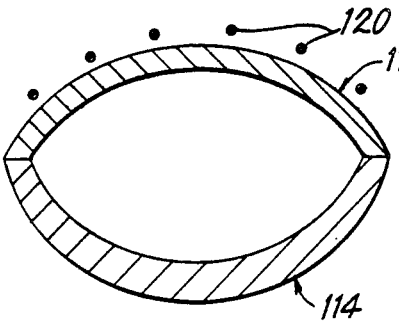
FIG. 8A is a section view, taken along line 8A—8A in FIG. 8.

As shown in FIG. 8A, the fingerboard 118 of the guitar 110 has a substantial convex curvature when viewed in cross section. This makes string bending and pulling easier for playing with either hand.

Figure 9:
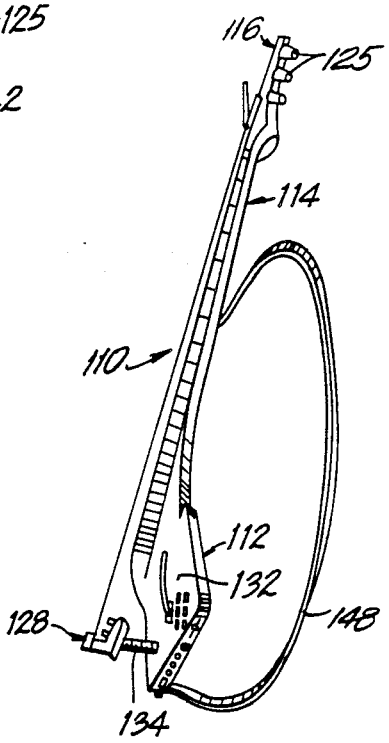
FIG. 9 is a side elevation view of the guitar of FIG. 8 as viewed from the right side of FIG. 8.
Figure 13:
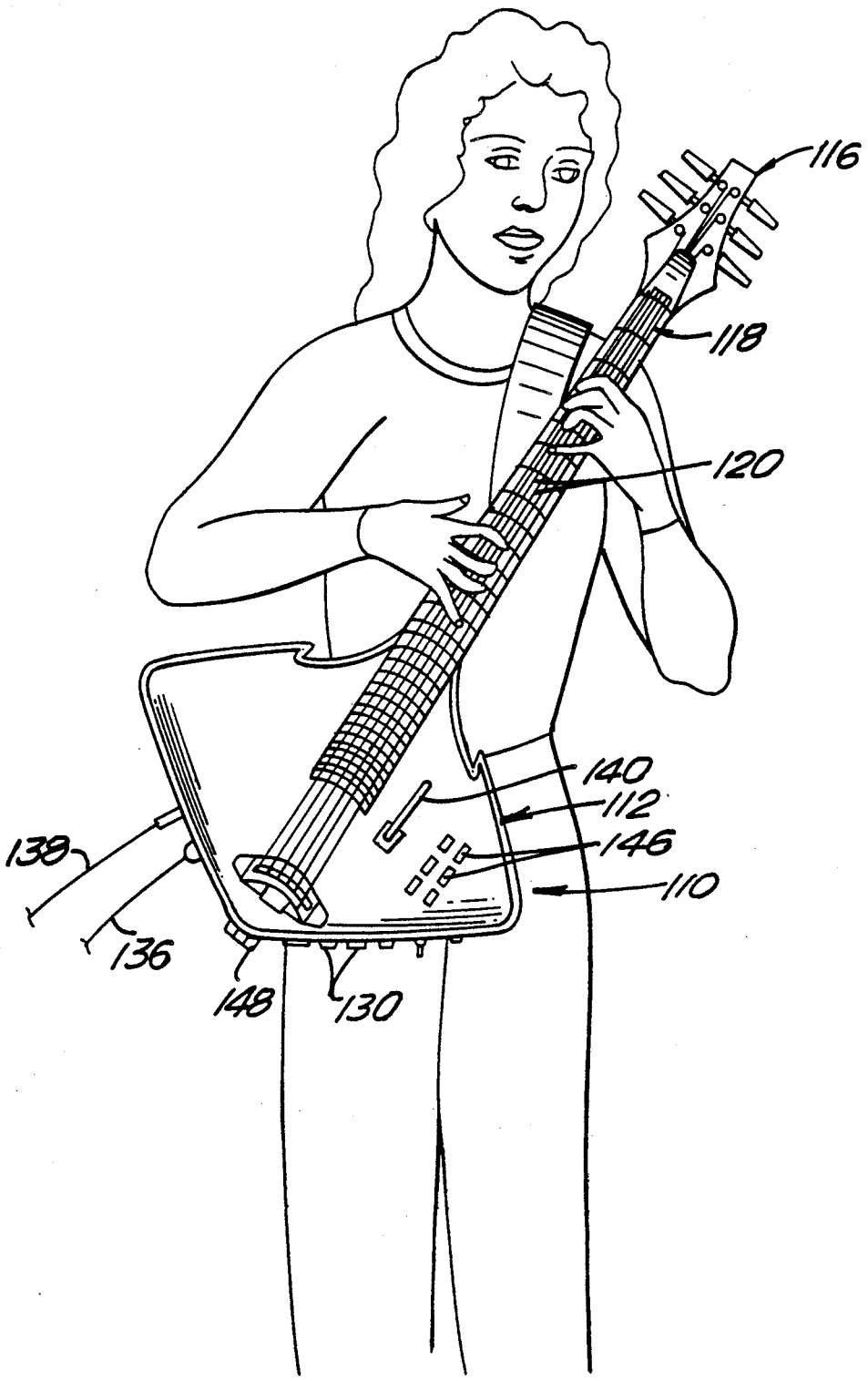
FIG. 13 is a schematic perspective view of a method of playing the guitar of FIG. 8 in accordance with this invention.

As shown in FIG. 9, the guitar 110 also has its neck 114 and its fingerboard 118 at an acute angle to its body 112. The specific acute angle utilized is not critical but is preferably about 5° to 15°. The acute angle of the neck 114 and fingerboard 118 to the body 112 of the guitar 110 makes it easier to play the guitar by the hand-over-hand method with the back of the body 112 resting against the stomach area of the guitarist and the neck 114 of the guitar extending diagonally across the guitarist's chest as shown in FIG. 13. So that the strings 120 do not contact the fingerboard 118 due to the acute angle of the neck 114 and fingerboard 118 relative to the body 112, the bridge 128 is preferably elevated above the face 119 of the body 112. For this purpose, posts 134 are provided beneath the sides of the bridge 128 for supporting the bridge above the face 119 of the body 112 and for electrically connecting the electrical pick-up 127 with electronic circuitry shown in black box form in dotted lines at C within the body 112.

As also shown in FIG. 8, the guitar 110 includes one or more conventional electrical connectors 136 and 138 for connecting the electronic circuitry within the body 112 of the guitar to an electrical outlet and to a sound amplification system (not shown). the guitar 110 also includes two tremelo levers 140 and 142 which are electrically connected to the electronic circuitry within the body 112 of the guitar 110. The tremelo levers 140 and 142, when operated, vary the pitch of the sound produced by the strings 120 of the guitar and are placed in a novel manner on the guitar itself; one tremelo lever 140 is preferably located on the face 119 of the body 112, between the bridge 128 and the fingerboard 118. The other tremelo lever 142 is preferably located on top of the headpiece 116 adjacent the nut 144. In conventional electric guitars, the pitch is changed by varying the tension on the strings.

As also shown in FIG. 8, the guitar 110 includes a plurality of control knobs 130 on one side of the body 112 for controlling the volume and tone of the guitar. Preferably, the guitar 110 also includes a plurality of control buttons 146 on the face 119 of the body 112, adjacent the tremelo lever 140. The control buttons 146 are connected to the electrical circuitry within the body 112 and can alter the melodic tonality or expression produced by the guitar 110. For example, one or more control buttons 146 can serve to transpose pitch, change octaves, control bass tonality, change key, or change timbre to simulate the sound of other instruments such as a flute or saxophone.

As further shown in FIG. 8, a strap 148 is connected to the rear corner 123 of the body 112 and to about the middle of the neck 114. The construction and location of the strap 148 on the guitar 110 are not critical, so long as the strap enables a guitarist to play the guitar 110 in the manner shown in FIG. 13. In this regard, the strap 148 should hold the guitar 110 with its neck 114 diagonally across the guitarist's chest and in such a position that the guitarist can tap, bend or pull the strings with either hand and the guitarist can also use hand-over-hand playing techniques without the guitar 110 shifting position.

Figure 10:
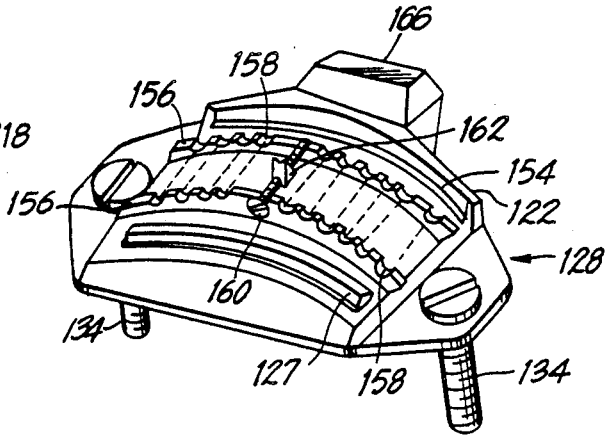
FIG. 10 is a schematic perspective view of the bridge of the guitar of FIG. 8.
Figure 11:
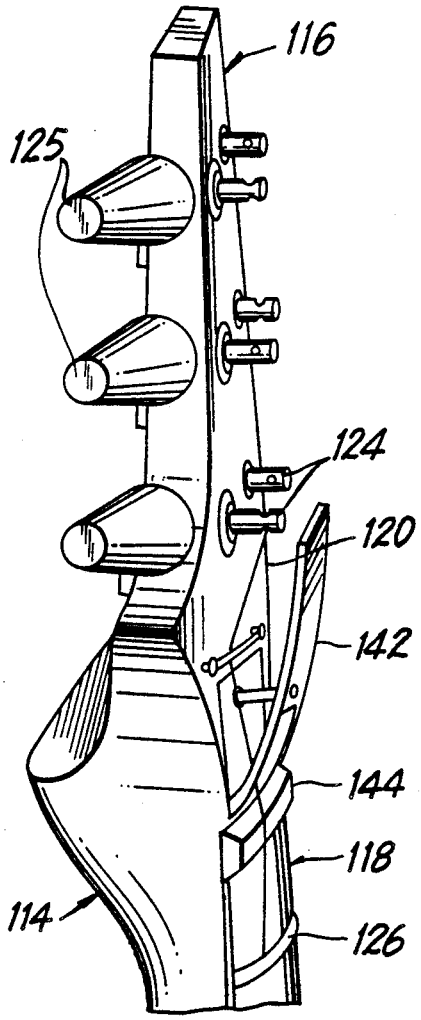
FIG. 11 is a fragmentary perspective view of the guitar of FIG. 8, showing its headpiece, the nut connecting its headpiece to its neck and a tremelo lever provided over the nut.
Figure 12:
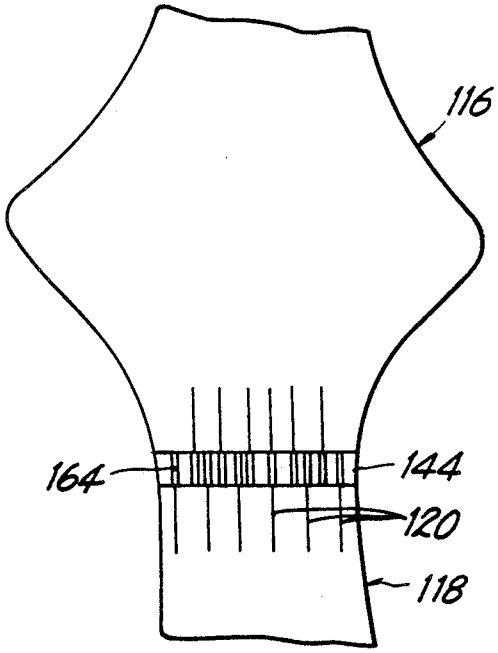
FIG. 12 is a top plan view of the nut of the guitar of FIG. 8, with the tremelo lever, shown in FIG. 11, removed.

Shown in FIG. 10 is the novel bridge 128 of the guitar 110. The bridge 128 has the sound pick-up 127 extending across its front and the tail piece 122 across its rear. In this regard, the tail piece 122 is formed with a slot 154 extending through it from front to rear, and a washer (not shown) on the rear end of each strings 120 can be aligned horizontally, inserted through the slot 154 and then aligned perpendicularly to the slot 154 so that the washer cannot be pulled frontally through the slot 154. The bridge 128 also includes a pair of parallel bridge members 156 having aligned grooves 158 in the tops thereof. The bridge members 156 are adapted to have screws 160 placed in their grooves 158, with each screw 160 threadedly engaged with a hole in an upstanding tooth 162, through which the screw 160 extends. Each tooth 162 is adapted to support one of the strings 120 above the fingerboard 118 and the bridge members 156 between the pegs 124 and the slot 154 in the bridge 128. As shown in FIG. 10, each of the bridge members 156 has more than six grooves 158. Likewise, the nut 144 is provided with more than six grooves 164 therein as shown in FIG. 12. This makes it possible to vary the spacing between the strings 120 in the guitar 110, for example, to accommodate the guitarists' fingers while playing a prolonged lead on a given string or strings with the fingers of both hands.

The bridge 128 also includes an electronic display, such as an L.E.D. display 166 at the rear of the bridge. The electronic display 166 is electrically connected to the electronic circuitry (not shown) within the body 112 of the guitar 110 and preferably to the control buttons 146 on the face 119 of the guitar body 112. The display 166 is adapted to indicate which of the control buttons 146 had been activated.

Shown in FIG. 13 is one method of playing the guitar 110 of this invention. As shown in FIG. 13, a guitarist can play the guitar 110 with the fingers of both hands. In this regard, the guitarist can suitably use up to eight fingers simultaneously for tapping, pulling or binding the strings 120 and, if desired, using hand-over-hand techniques for linking melody and chord patterns together. As also seen in FIG. 13, the fingerboard 118 extends diagonally across the chest of the guitarist and the guitar can stay in this position, while being played, because of the strap 148 and because the weight of the body 12 counterbalances the weight of the neck 14, headpiece 16 and the portions of the fingerboard 18 on the neck 14.

FIGS. 14A–F compares the indicia for sharps and flats on conventional fret boards with indicia on the guitar of the invention. The indicia locate the fingers of both hands so that the instrumentalist can shift their placements without losing continuity. If any artist should play the two-hand method on a standard fret board using standard markers along, such shifting would not coincide with the standard marked fret board. Also, the hands would misalign with the conventional stringed instrument markers.

In FIGS. 14A–14F, the white circles represent the standard key signature markings on a standard guitar; the black dots represent the finger positions for the fingers of both hands; and the oval indicia represent the indicia of the invention.

Figure 14A:
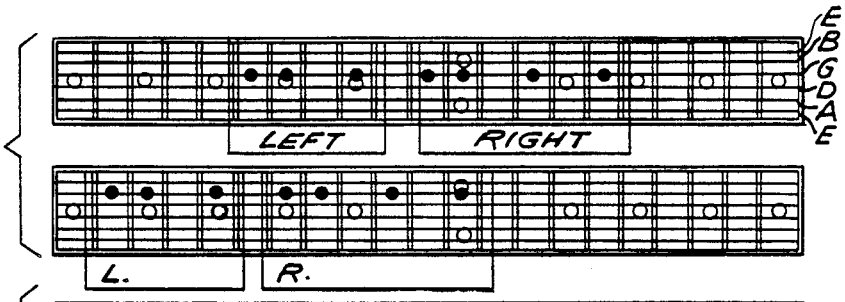
FIGS. 14A-14F comprise six diagramatic plan views of fret boards incorporating visual markings for sharps and flats and showing in FIGS. 14B, 14D and 14F a fret board incorporating sharps and flats indicia in accordance with the invention.

FIG. 14A shows a standard board and standard markings:

Using the same notes, the lower board shows a positional change of the hands from the G standard guitar string to the B standard guitar string; a simple moving of the hands to another string, keeping the same notes. In this example, the fingers and markers become "lost" in the confusing key signatures (or markers) changing place as between the two strings. These marks are not adaptable for the methods of the invention as played on the instrument of the invention.

Figure 14B:
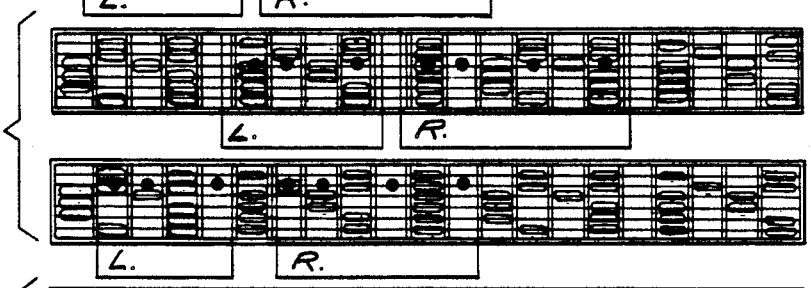

FIG. 14B shows the fret board of the invention with key signatures markings in accordance with the invention. As in FIG. 14A, using the same notes again, with the sharp and flat signatures, a positional change of the fingers of hands exactly as in FIG. 14A occurs. In this regard, here the fingers of both hands meet the string over the exact same visual order. The right and left hand produce continuity in the markings. Every marker is where it was as on the previous string.

FIG. 14C again sows standard markings:

Here is another exchange of the hands, however, only two fingers of each hand are being used to play. Moving the position of the hands from the D string to the B string (this could be any string change, the results are the same). Here is a confusing attempt at relocating the fingers of the hands relative to the standard markers. This time, both the hands loose continuity and become "lost" relative to the standard signature marker (still using the exact notes of the previous string).

Figure 14C:
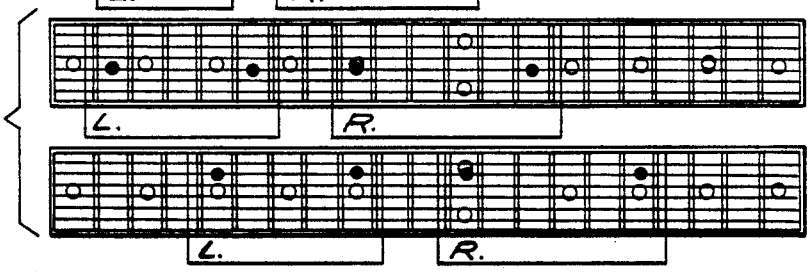
Figure 14D:
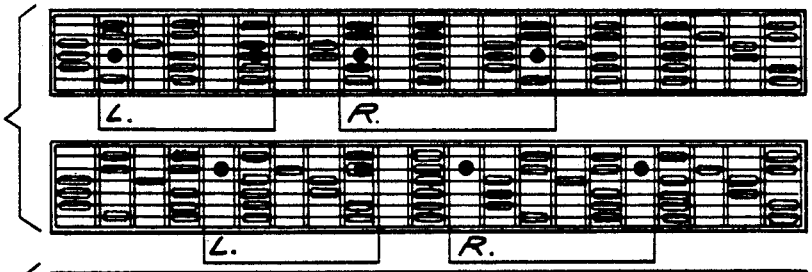

FIG. 14D again sows the indicia marks of the invention:

As in FIG. 14C, these same notes are here again used to demonstrate the validity of the new marks. Only two fingers from the both hands are now in use. The change is exactly that of FIG. 14C. This time with the indicia marks of the invention, The hands remain in perfect order with no continuity lost, and no problem locating the new shift in position. Each note, every time, follows a perfect order with the same fingers meeting the same indicia or lack thereof from one string to the next.

FIG. 14E again shows standard marking indicia:

though examples could infinitely go on, this final example shows a more complex position of the fingers of both hands, using the guitar's new made of playing. Here the player stretches his or her hands to produce a Major scale using all eight fingers. The player then repositions the exact same scale from the D string to the B string. Here in FIG. 14E, any attempt to see past the key signatures is completely futile. The left and right cover the indicia and the fingers of the hands are in total disorder relative to these conventional key signatures as between one string and the other.

Figure 14E:
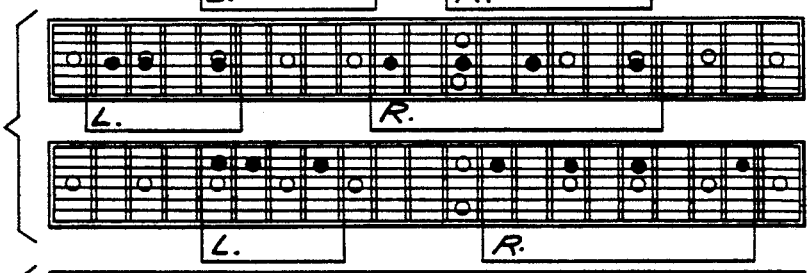
Figure 14F:
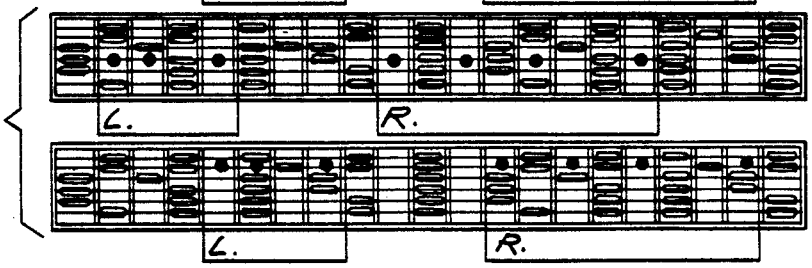

FIG. 14F uses the same positioning as in FIG. 14E with perfect correlation of the finger positions and indicia from one string to the next.

The idea of the individual string sharp and flat marker placement was conceived for the new playing mode. This is important because without separate string marking, to coordinate the two hands in operation of the technique the player would be unable to visually locate proper finger positioning, when overlapping in fast runs, or in replacing the combined hands to continue one scale or chord progression. In this instance, the tuning of the instrument must appear on the board of the stringed instrument by means of sharps and flats and marking where the half steps appear in the separate chromatic progression of each string, using the sharp flat markers as the visual indicia for finger placement.

Regarding the key signatures used on the conventional stringed instruments, FIG. 14 shows how the appearance of the sharps and flats aids in the above explanation, and how just having the key signatures cannot apply to the new technique, but also hinder the new mode of playing.

The invention contemplates the addition of sharp and flat markers for each individual string tuning. In regard to other visually marked stringed instruments, the Hawiian fret board disclosed in Frost No. 3,833,751 is the most visual, however, the board measures chromatic frequency in an old mode of measuring a plurality of strings together as one measure. Any specific musical notation applied on the Hawiian board are the conventional key signatures, which again measure the plurality of the strings together as one unit. These marks are found on all other guitars. Further, if the tuning of the strings were changed on the Hawiian or any other conventionally marked instrument, the board markings would be unaffected. Referring to the instrument of the invention, if the tuning were changed, the individual string markings would be affected and not useable for the different tuning.

To reiterate, the board indicia of the invention are directly dependent on the tuning, whereas the conventional, even Hawiian instrument marks are independent of the tuning. That is why in the Frost patent, Frost says, this kind of marking is good for learning other stringed fretted instruments as well, but Frost's markings could not apply to the present instrument, the marks of which would not apply to Frost, because of the new mode. The instrument of the invention can be premarked for any set string tuning and is not restricted to the conventional guitar tuning.

It is considered that the invention and many of its attendant advantages will be understood from the foregoing description and that it would be apparent that various changes can be made in the elements of the described guitars and in the described method of playing them without departing from the spirit and scope of the invention or sacrificing all of its material advantages, the guitars 10 and 110 and the method for playing them, hereinbefore described, be merely preferred embodiments.

I claim:

1. A method of playing a fretted string instrument having a body, a neck, a single elongated fingerboard on said neck and conventional strings in tension over said body between a head and bridge thereof; said fingerboard extending rearwardly of said neck over said body and including at least about twenty-five frets, a substantial number of which frets overlie said body, means for retaining said instrument against the body of the instrumentalist and angularly disposed relative to the vertical, said fingerboard being outwardly convexed, the forward edges of said body adjacent the fingerboard diverging rearwardly, said fingerboard thereby being accessible to the fingers of both hands approaching said fingerboard from opposite sides throughout the length of said fingerboard, neck and body, said method comprising the instrumentalist retaining the instrument against the instrumentalist's body and angularly disposed relative to the vertical with the single fingerboard facing outwardly, approaching said strings with the fingers of one hand from one side of said fingerboard and with the fingers of the other hand from the other side of said fingerboard, and tapping, bending and pulling at least one of the strings along the length of said fingerboard with the fingers of both hands by applying the fingers of one hand to the at least one string, then applying the fingers of the other hand in advance of the position of the one hand and then applying the fingers of the other hand again in a position in advance of the position of the other hand in either direction.

* * * * *